United States Patent [19]

Schuh

[11] Patent Number: 4,621,691

[45] Date of Patent: Nov. 11, 1986

[54] WELL DRILLING

[75] Inventor: Frank J. Schuh, Plano, Tex.

[73] Assignee: Atlantic Richfield Company, Los Angeles, Calif.

[21] Appl. No.: 752,755

[22] Filed: Jul. 8, 1985

[51] Int. Cl.[4] ..... E21B 43/16; E21B 7/06; E21B 43/30

[52] U.S. Cl. ..... 166/268; 166/245; 175/61; 175/62

[58] Field of Search ..... 175/61, 62; 166/245, 166/268, 50, 52, 256; 299/4

[56] References Cited

U.S. PATENT DOCUMENTS

| | | | |
|---|---|---|---|
| 3,386,508 | 6/1968 | Bielstein et al. | 166/52 X |
| 3,513,913 | 5/1970 | Bruist | 166/245 |
| 4,022,279 | 5/1977 | Driver | 175/61 X |
| 4,220,203 | 9/1980 | Steeman | 166/50 X |
| 4,311,340 | 1/1982 | Lyons et al. | 299/4 |
| 4,334,580 | 6/1982 | Vann | 175/62 X |
| 4,386,665 | 6/1983 | Dellinger | 175/61 |
| 4,390,067 | 6/1983 | Willman | 166/245 |
| 4,442,896 | 4/1984 | Reale et al. | 166/50 X |
| 4,461,349 | 6/1984 | Wunderlich | 166/245 |
| 4,512,400 | 4/1985 | Simon | 166/245 |

*Primary Examiner*—Stephen J. Novosad
*Assistant Examiner*—Michael A. Goodwin
*Attorney, Agent, or Firm*—Roderick W. MacDonald

[57] ABSTRACT

A method for drilling a plurality of wellbores for producing an oil and/or gas field to the maximum extent with the least number of wellbores wherein at least two longitudinally extending drilling zones are established spaced apart and essentially parallel to one another and drilling alternate longitudinally spaced apart curved wellbores from said drilling zones, each curved wellbore extending toward the producing formation and the opposing drilling zone, each curved wellbore being straightened out and thereafter following a predetermined producing formation until the wellbore reaches the vicinity of the opposing drilling zone. A plurality of the alternating longitudinally spaced wellbores are employed along a pair of drilling zones and a plurality of pairs of drilling zones can be employed. The resulting series of wellbores can be employed to carry out an enhanced oil recovery process by using part of said wellbores as injection wells and part of said wellbores as producing wells.

3 Claims, 3 Drawing Figures

WELL DRILLING

BACKGROUND OF THE INVENTION

Heretofore, oil and/or gas fields have been developed onshore by drilling a plurality of essentially vertical, spaced apart wellbores in checkerboard fashion. In the offshore environment, a plurality of curved wellbores have been drilled from a single platform, each curved wellbore extending outwardly in a different direction away from the platform.

BRIEF SUMMARY OF THE INVENTION

In accordance with this invention, there is employed a method for drilling a plurality of wellbores to develop an oil and/or gas field which uses curved wellbores but which uses such wellbores in a manner significantly different from that of the prior art. In this invention, at least one pair of elongate drilling zones which are essentially parallel to and spaced from one another are employed across a substantial portion of the oil and/or gas field to be developed. Alternate curved wellbores are drilled along the length of both drilling zones, adjacent wellbores being longitudinally spaced from one another. Each wellbore is deliberately directed toward a predetermined oil and/or gas producing formation and the opposing drilling zone. When the wellbore reaches the predetermined oil and/or gas producing formation, the wellbore is straightened to thereafter follow the formation until the wellbore reaches the vicinity of the opposing drilling zone. A plurality of such alternate longitudinally spaced curved wellbores are drilled along any given pair of drilling zones and a plurality of pairs of drilling zones can be employed to develop fields of larger areas.

Accordingly, it is an object of this invention to provide a new and improved method for developmental drilling of an oil and/or gas field. It is another object to provide a new and improved method for maximum developmental drilling of a producing field with the least number of wellbores. It is another object to provide a new and improved method for developmental drilling for carrying out enhanced oil recovery processes.

Other aspects, objects and advantages of this invention will be apparent to those skilled in the art from this disclosure and the appended claims.

DETAILED DESCRIPTION OF THE INVENTION

Figure 1:
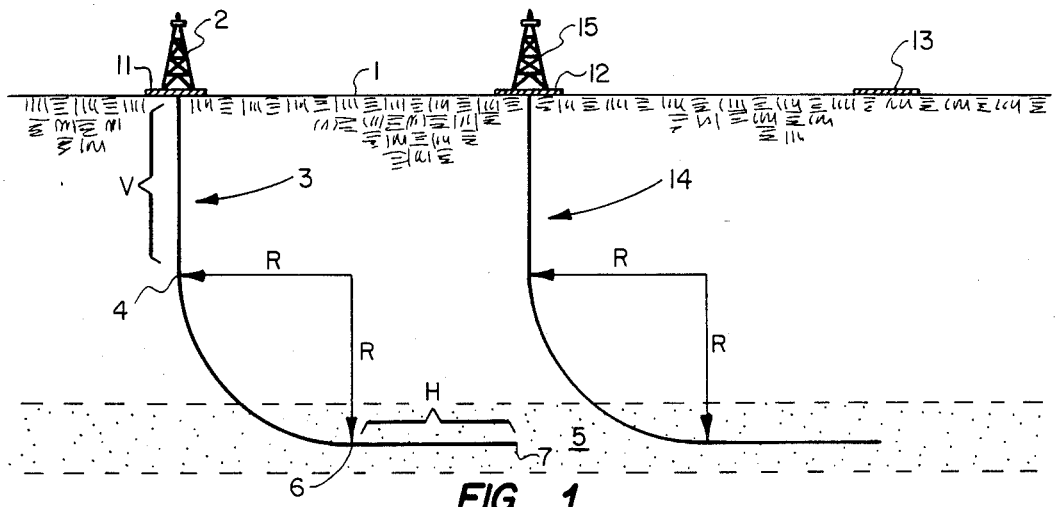
FIG. 1 shows a cross section of the earth with a wellbore extending downwardly from the surface and then curving towards and into a producing formation after which the wellbore is straightened to follow the formation.

FIG. 1 shows the earth's surface 1 with a drilling rig 2 mounted thereon. A wellbore 3 is drilled from rig 2.

Wellbore 3 starts initially as a conventional essentially vertical wellbore which is denotated in FIG. 1 by the portion V. At kick-off point 4, wellbore 3 is curved from vertical in a conventional manner. A radius of curvature R is employed which is designed, based upon the depth of producing formation 5, to reach a point 6 in the interior of formation 5 at which point 6 the curving wellbore 3 is straightened so that an essentially straight portion H of wellbore 3 can be drilled following along formation 5.

Figure 2:
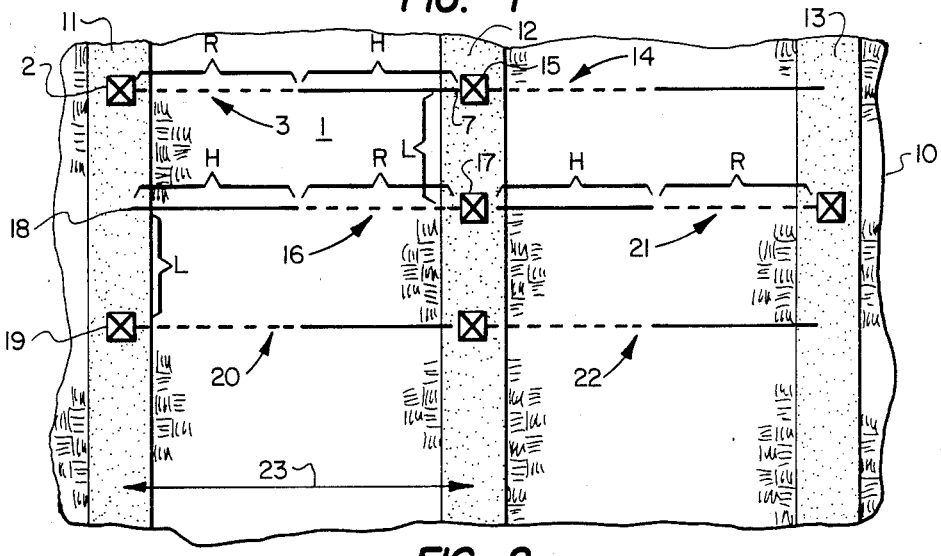
FIG. 2 shows a plan view of the development of a field in accordance with this invention using a plurality of spaced apart drilling zones and a plurality of curved wellbores drilled along and away from each drilling zone.

FIG. 2 shows the irregular outline 10 of an oil and/or gas field. Across a substantial portion of field 10 are laid out elongate drilling zones 11, 12 and 13 on the surface of the earth 1. Drilling zones 11 through 13 can be a continuous roadway or merely an imaginery zone along which wells are to be drilled at various drill sites.

Drilling zones 11 and 12 form a pair of spaced apart longitudinally extending drilling zones which are essentially parallel to one another, although true parallelism is not required. If the first drilling site on first drilling zone 11 is denotated by drilling rig 2, then it can be seen that wellbore 3 curves from kick-off point 4 towards producing formation 5 and, at the same time, towards opposing, second drilling zone 12. Note that the curved portion R of wellbore 3 extends across a substantial part of the space between opposing adjacent drilling zones 11 and 12 and that the remainder of such space is covered by essentially straight wellbore portion H.

Wellbore portion H is shown in FIG. 1 to be essentially horizontal, although this may not necessarily be the case in actual practice if formation 5 is tilted upwardly or downwardly from point 6. However, for sake of simplicity, portion H will be described as the horizontal portion of the wellbore although it is to be understood that this portion does not need to be truly horizontal anymore than vertical portion V need be truly vertical.

Horizontal portion H extends toward opposing drilling zone 12 and is terminated somewhere in the vicinity of drilling zone 12. That is to say, end 7 of wellbore 3 is somewhere near or under drilling zone 12 although it should not extend until it interferes with curved wellbore 14 which extends from drilling rig 15 towards opposing drilling zone 13. Although wellbore 3 is shown to be drawn essentially perpendicular to drilling zones 11 and 12, this is not a requirement for this invention. Wellbore 3 could be drilled at an angle to drilling zones 11 and 12 if desired or necessary and the benefits of this invention still achieved. For example, this might be done in some fields to more precisely fit the direction of the minimum horizontal stress and hydraulic fracture planes of the producing formation in question. This modification would increase the length of the drilling zones and the surface distance between wellheads and decrease the perpendicular distance between drilling zones but would not change the number of wells required for a given subsurface spacing of horizontal well paths.

In accordance with this invention, after drilling first curved wellbore 3 from first drilling zone 11, a first curved wellbore 16 is drilled from second drilling zone 12 by use of drilling rig 17. Curved wellbore 16 curves toward formation 5 and, at the same time, toward opposing drilling zone 11 so that the resulting curved wellbore 16 looks like wellbore 3 of FIG. 1 but curves in the opposite direction. End 18 of the horizontal portion H of curved wellbore 16 terminates in the vicinity of drilling zone 11.

Wellbore 16 is deliberately drilled so that it is longitudinally spaced a distance L from wellbore 3 along the length of drilling zones 11 and 12.

Thereafter, drilling rig 19 which can be the same or different rig as those used for 2 or 17, is employed to drill from drilling zone 11 a third longitudinally displaced curved wellbore 20 which extends over to the vicinity of opposing drilling zone 12. This drilling of alternating curved wellbores is repeated along the length of drilling zones 11 and 12 for a distance deemed necessary for adequate developmental drilling of that portion of field 10.

If field 10 is sufficiently large in area that a single pair of drilling zones 11 and 12 does not adequately develop the field, then additional pairs of drilling zones can be employed such as drilling zones 12 and 13 of FIG. 2 using alternating longitudinally spaced apart curved wellbores 14, 21, and 22 which are drilled in the same manner as wellbores 3, 16 and 20.

The distances R, H, and L can vary widely depending upon the depth of formation 5, the capacity of the drilling rigs being used, the spacing between adjacent opposing drilling zones and a number of other factors. For example, this invention can be employed when a plurality of producing zones are available in which case, a single predetermined producing zone will be used as a target zone, as shown in FIG. 1 for formation 5.

Figure 3:
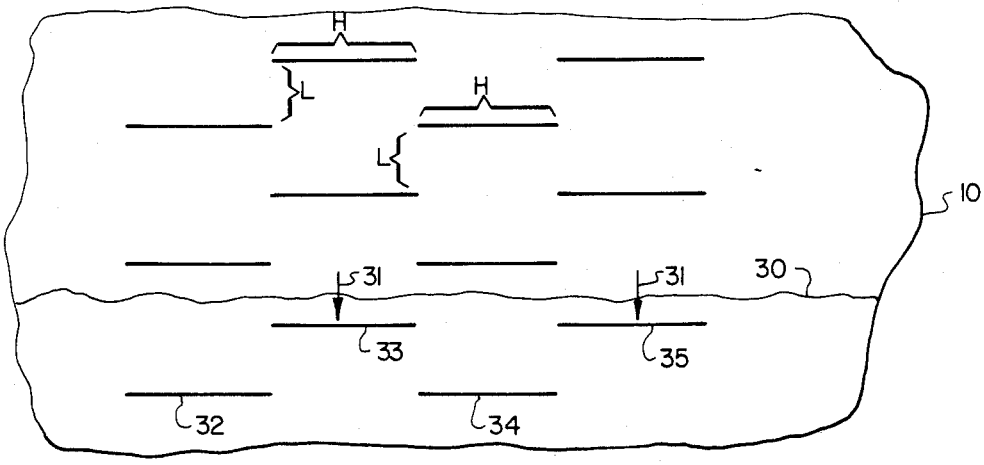
FIG. 3 shows a plan view of the various straightened portions of the curved wellbores of FIG. 2 and how these wells can be employed in an enhanced oil producing process.

After field 10 has been developed by drilling curved wells in the manner described for FIG. 2, when considering only the horizontal portions of each wellbore, a staggered sequence of horizontal wellbores is achieved as shown in FIG. 3, each horizontal portion being spaced from the other by a longitudinal length L. If a plurality of wellbores near the top side of field 10 in FIG. 3 are employed to inject an oil production enhancing fluid, e.g. a micellar displacement or miscible displacement fluid, into formation 5, a bank of such fluid can be formed in formation 5 to form a line drive 30 in that formation. Then, with additional injection of the oil production enhancing fluid and/or a drive fluid to push the oil production enhancing fluid, a line drive 30 is formed from such fluid(s) and pushed in the direction of arrows 31 so that a greater amount of oil than normal can be produced from production wells which lie ahead of line drive 30, e.g., wells 32 through 35 in FIG. 3. It can be seen from the pattern of overlapping horizontal portions H, that essentially complete coverage of field 10 can be achieved and enhanced oil recovery realized by using the drilling pattern of this invention as disclosed hereinabove with respect to FIG. 2. If an enhanced oil recovery process is anticipated, the original curved wells could be drilled in a direction that essentially parallels the expected plane of the vertical fractures for formation 5. With this arrangement, injection in a well could cause a fracture that would extend vertically upward to the top of formation 5 and laterally along the length of the horizontal hole H. This could tend to more uniformly distribute the injected enhanced oil recovery fluids across the full face of producing formation 5 and could also prevent streaks from causing vertical flow barriers.

Although the radius of curvature R and horizontal distance H can vary widely depending upon the drilling apparatus available, the nature of formation 5 and many other parameters, for sake of example, if the curved portion of the wellbore has a build rate of $2\frac{1}{2}°$ per 100 foot of wellbore drilled, this is equivalent to a radius of curvature R for the wellbore of 2300 feet. If formation 5 is about 3500 feet below the earth's surface 1, wellbore 3 could be drilled vertically to a depth of 1200 feet at point 4 at which time, the wellbore would be kicked off of vertical and start to build at $2\frac{1}{2}°$ per 100 foot towards horizontal.

Thus, wellbore 3 would curve from point 4 to point 6 a lateral distance of 2300 feet away from the vertical projection of wellbore 3. If drilling zones 11 and 12 are spaced 4600 feet apart as indicated by arrow 23 in FIG. 2, center-to-center, and horizontal distance H of wellbore 3 is also 2300 feet, then wellbore 3 will reach essentially to the center of drilling zone 12. The foregoing would also be true for each of wells 16, 20, 14, 21, 22, using the 2300 foot radius of curvature, 2300 foot horizontal segment H for a total of 4600 feet between adjacent opposing drilling zones.

In this situation, it would take 10 wells per 1000 foot of longitudinal length L of drilling zone in order to place the horizontal drainhole segment on 200 foot spacing in formation 5. In an area of 528 acres, 50 wells would be employed if drilled in the manner described in relation to FIG. 2 and this would yield a total wellbore contact length with formation 5 of 115,000 feet. It would require about 2300 vertical wells in a 50 foot thick producing formation 5 to have the same 115,000 foot contact length produced by following the pattern of this invention. Accordingly, by this invention, there is produced an equivalent well spacing from a surface contact point of view of 0.238 acres per well by drilling 50 wells in 528 acres or roughly 1 well for every $10\frac{1}{2}$ acres of surface area.

The 2300 foot radius of curvature and length of horizontal segment H is not required for this invention. Other curvatures and horizontal lengths can be employed to provide even greater incentives. For example, with a 2640 foot radius of curvature, the horizontal tail and build portion would be lengthened by a little over 500 feet to a measured depth of 7647 feet but would permit placing adjacent opposing drilling zones essentially one mile apart.

It can be seen from the above description of this invention even if the effective cost of the curved wellbores employed by this invention were twice the cost per foot of conventional vertical wellbores, the horizontal wellbores would be less than one-tenth the cost of wells required for the pattern than vertical wellbores so that substantial net savings could be realized from the proper application of this invention even though more expensive wellbores are employed in carrying out the pattern of this invention.

Reasonable variations and modifications are possible within the scope of this disclosure without departing from the spirit and scope of this invention.

I claim:

1. In a method for drilling a plurality of wellbores in at least one producing formation in an oil and/or gas field for maximum development of said field with the least number of wellbores, the improvement comprising providing at least two spaced apart longitudinally extending drilling zones which are essentially parallel to one another, said at least two drilling zones extending across a substantial portion of said field, drilling a first downwardly extending wellbore from a first site on a first of said drilling zones, said first wellbore curving toward the second of said drilling zones, straightening said first wellbore when it reaches a predetermined producing formation, continuing to drill said first wellbore along said predetermined producing formation toward said second drilling zone, terminating said first wellbore in the vicinity of said second drilling zone, drilling a second downwardly extending separate wellbore which is unconnected with said first wellbore from a first site on the second of said drilling zones, said first site on said second drilling zone being longitudinally displaced from said first site on said first drilling zone, said second wellbore curving toward said first drilling zone, straightening said second wellbore when it reaches the same predetermined producing formation, continuing to drill said second wellbore along said predetermined producing formation toward said first drilling zone, terminating said second wellbore so that it remains separate from and unconnected with said first wellbore and in the vicinity of said first drilling zone, and continuing the alternate drilling of longitudinally spaced apart curving wellbores along said first and second drilling zones for a substantial length of said drilling zones.

2. The method according to claim 1 wherein additional pairs of spaced apart, essentially parallel drilling zones are employed in said field with alternate, longitudinally spaced, curved wellbores drilled along a substantial length thereof.

3. The method according to claim 1 wherein an enhanced oil recovery process is carried out in said field which requires injecting at least one oil production enhancing fluid along a length of said field to establish a line drive of said fluid and then moving said line drive by continued injection of fluid across a substantial portion of said field while producing oil from wellbores which lie ahead of said line drive, and wherein a plurality of said curved wellbores are employed as injection wells to establish and move said line drive, and a plurality of said curved wellbores ahead of said line drive are employed to recover said enhanced oil production.

* * * * *